US005505239A

United States Patent [19]

Sparks

[11] Patent Number: 5,505,239

[45] Date of Patent: Apr. 9, 1996

[54] BLADE ARRANGEMENT AND BLADE HOLDER FOR CHIPPER

[75] Inventor: James R. Sparks, Yamhill, Oreg.

[73] Assignee: U.S. Natural Resources, Vancouver, Wash.

[21] Appl. No.: 404,357

[22] Filed: Mar. 14, 1995

[51] Int. Cl.[6] ..... B27G 13/04

[52] U.S. Cl. ..... 144/220; 144/162 R; 144/218; 144/241

[58] Field of Search ..... 144/162 R, 176, 144/220, 230, 235, 225, 241; 407/37, 40, 41, 94, 95

[56] References Cited

U.S. PATENT DOCUMENTS

| | | | |
|---|---|---|---|
| 3,777,793 | 12/1973 | Miller | 144/220 |
| 4,082,127 | 4/1978 | Miller | 144/220 |
| 4,266,584 | 5/1981 | Lomnicki | 144/220 |
| 4,444,233 | 4/1984 | Miller | 144/220 |
| 5,271,442 | 12/1993 | Carpenter et al. | 144/162 R |

*Primary Examiner*—W. Donald Bray
*Attorney, Agent, or Firm*—Robert L. Harrington

[57] ABSTRACT

A blade holder for a chipper having a support that is configured to accommodate chip flow. The support is scoop shaped to provide a guide surface to guide the chips through the chipper while avoiding damaging impact. The chipper blades are in two parts and fitted together in end-to-end abutment and forming a bend at their juncture. One of the blade ends is grooved to receive an end edge of the other blade whereby the juncture is overlapped for added strength and to resist wood fibers being wedged into the juncture.

5 Claims, 5 Drawing Sheets

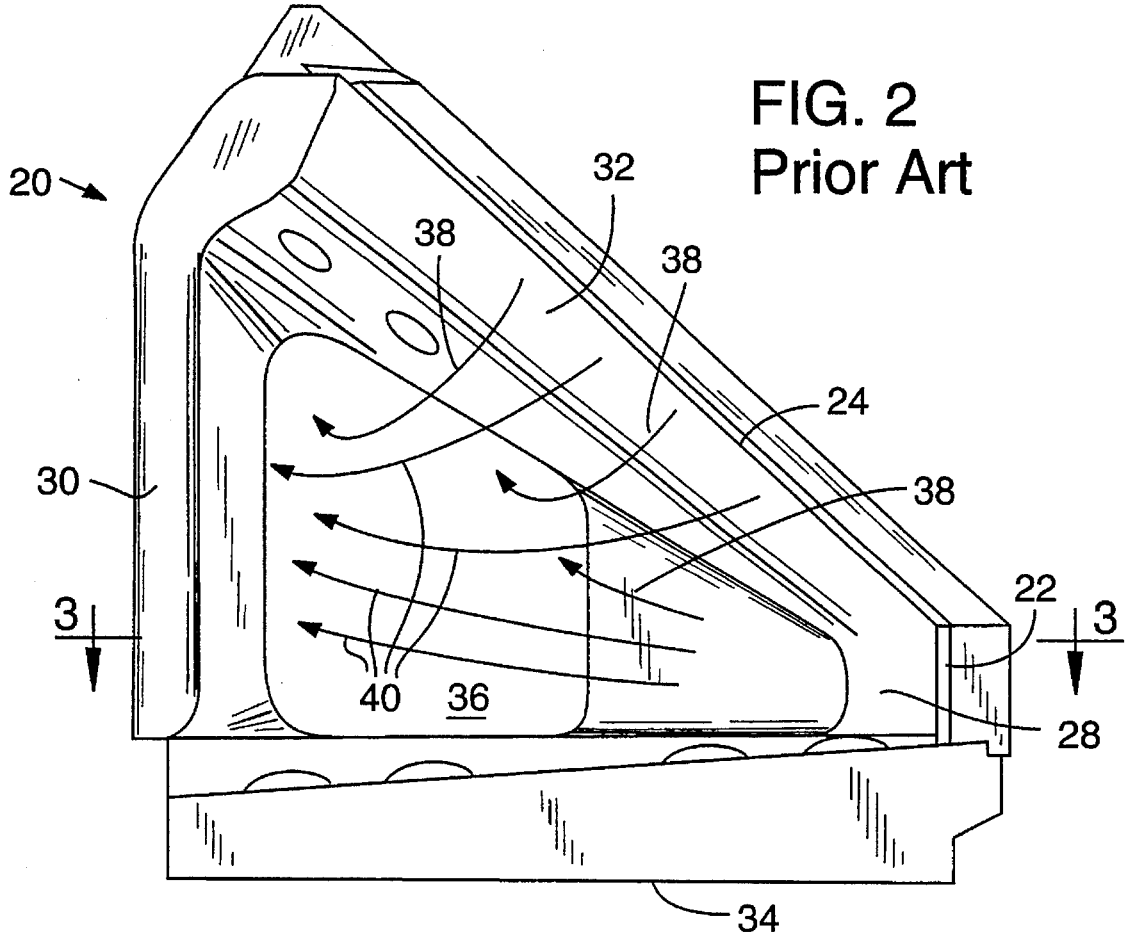
FIG. 2
Prior Art
FIG. 3 Prior Art
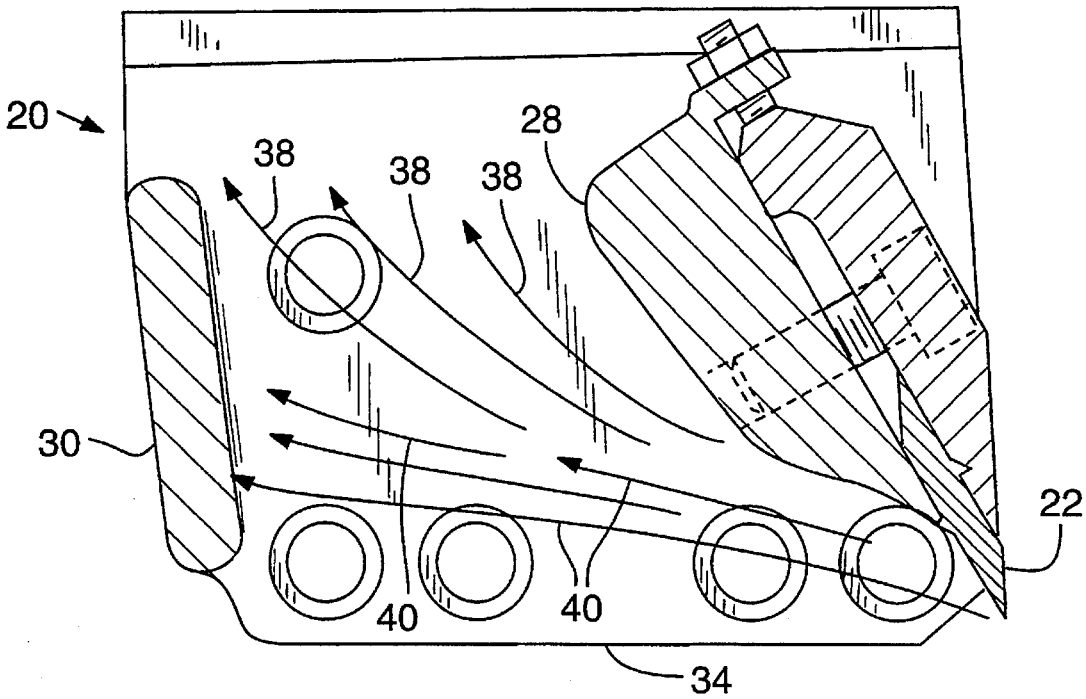

BLADE ARRANGEMENT AND BLADE HOLDER FOR CHIPPER

FIELD OF THE INVENTION

This invention relates to a blade holder for a chipper wherein the blade holder is configured to accommodate chip flow, and to a two-piece blade arranged to have protective overlapping.

BACKGROUND OF THE INVENTION

A common use for a chipper is to open the faces of a log. A log is generally round in shape and lumber production from the log requires a flat surface. For example, the first board to be cut may require 3–3½ inches of flat surface width at its minor face. Thus, the first operation will likely remove the log material at two opposed sides, i.e., outside of a vertical chord through each side of the log, the height of the vertical chord representing the width dimension of the minor face of the board to be cut. The material so removed is valuable as chips for making pulp. It is, therefore, desirable to cut the material into chips of a generally consistent size. Whereas the log material to be removed may be sawed off and then chipped, that requires two operations. Chippers of the present invention are designed to produce the desired open flat surfaces or faces and in the process to remove the side material from the log as chips.

A chipper includes a rotating disk on which multiple blade holders are peripherally mounted. Chipper blades are removably and adjustably mounted in the blade holders. The holders are massive steel members designed to withstand the shock and abuse of high speed impact when cutting into a fast moving oncoming log.

Two inter-related problems are addressed by the present invention. The holder includes support legs that are anchored to the periphery of the disk. A blade holding body portion is spaced above the disk periphery and is supported at its ends by the support legs. An opening is provided under the body portion and between the legs to allow chips to flow past the blade and blade holder. However, a substantial portion of the chips strike the outer support leg and are damaged insofar as being desirable for chip production. This damage has been heretofore considered unavoidable as the support is considered necessary for retaining the rigid resistance to the impact encountered by the holder.

The second problem also relates to chip flow. The two blade portions are abutted together to make a corner or bend. The corner area is a high impact area and although the joint is tightly formed, wood strands are driven into the corner and become wedged between the blade portions. This interferes with the cutting action and can mar or groove the opened face being formed on the log. This requires further operation down stream with additional material having to be removed.

BRIEF DESCRIPTION OF THE INVENTION

In the preferred embodiment, the spaced leg supports are replaced with a single support wall that extends from the forward face of the disk (the inner side) outwardly and rearwardly in a sweeping concave-like configuration that extends past the prior opening between the legs. The rearwardly curved or scoop shaped surface formed in the support wall provides a guide way that receives and directs or guides the chips past the holder in the direction of natural flow of the chips. There is no direct impact and furthermore the air flow created by the rapidly rotating scoop shaped holders simulates the chip flow and air turbulence and the noise created thereby is largely abated.

The blade arrangement provides for a V groove in the edge of one blade and a corner of the second blade is nested in the V groove. Thus, the blades are in overlapping or nested arrangement which improves blade rigidity and eliminates any gap between the blades wherein wood fibers can be wedged.

The invention and its advantages will be more fully appreciated with reference to the following detailed description and the drawings referred to therein.

BRIEF DESCRIPTION OF THE DRAWINGS

FIGS. 2 and 3 are front and top views of a prior art blade holder illustrating chip flow;

DETAILED DESCRIPTION

Figure 1A:
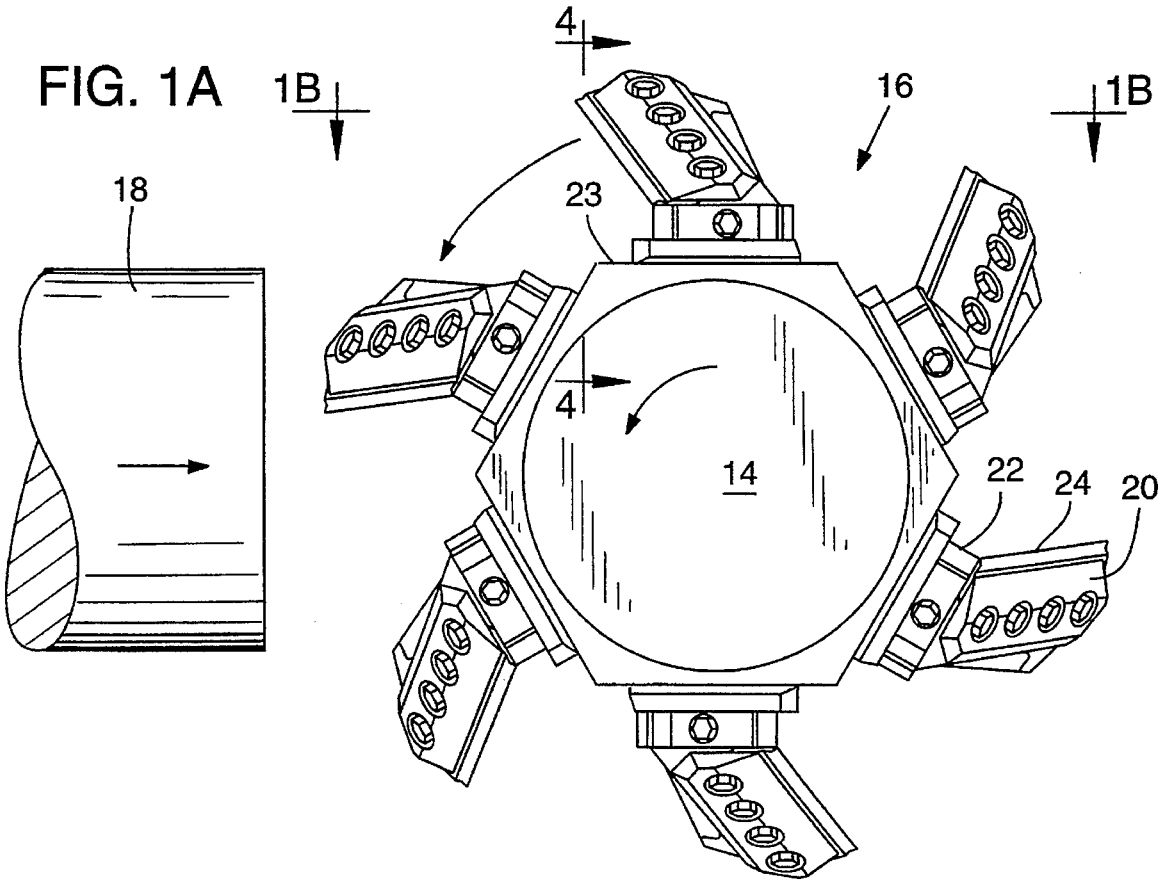
FIGS. 1A and 1B illustrate a chipper used to open a face of a log.
Figure 1B:
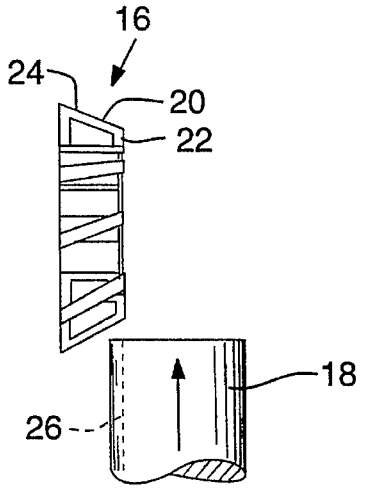
Figure 4:
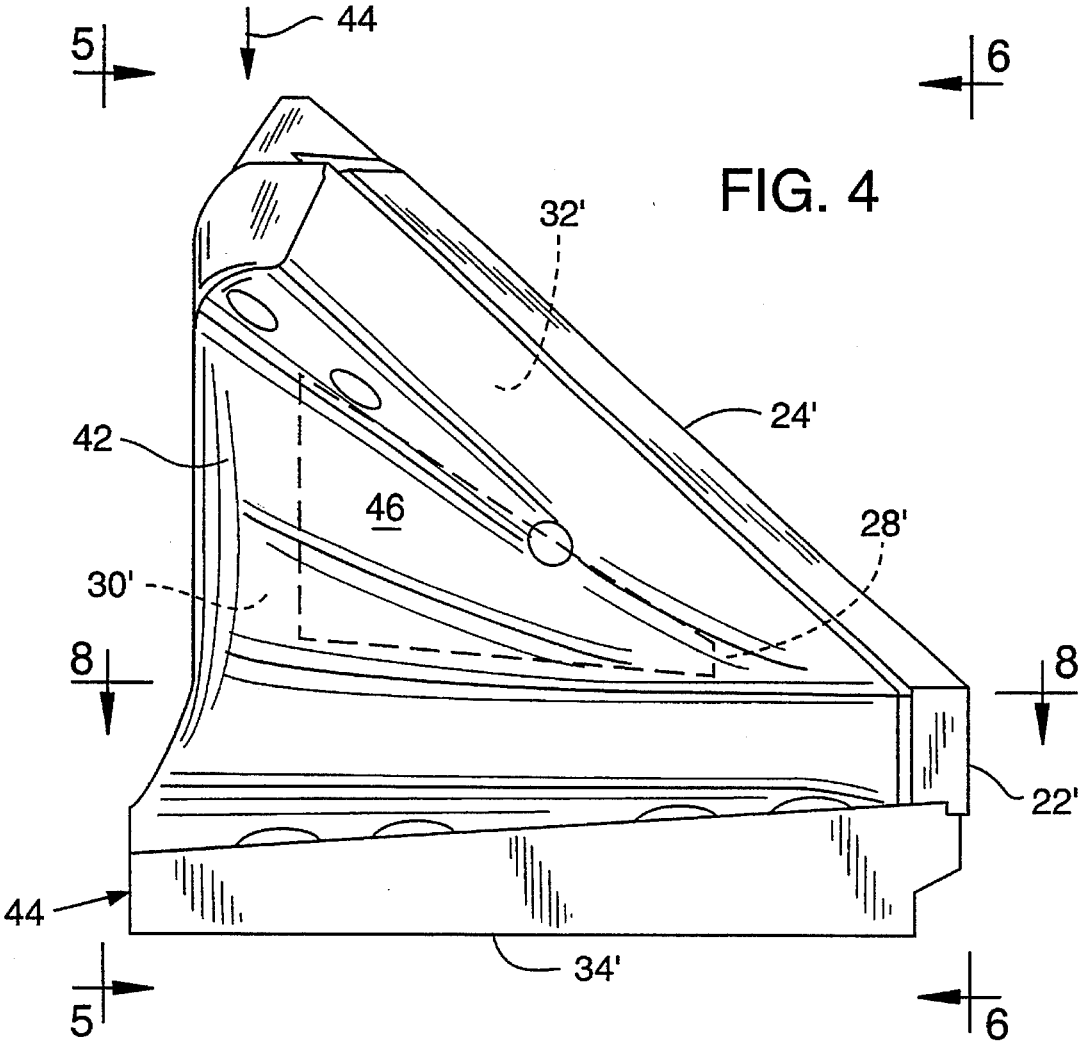
FIG. 4 is a front view of a blade holder in accordance with the present invention.
Figure 7:
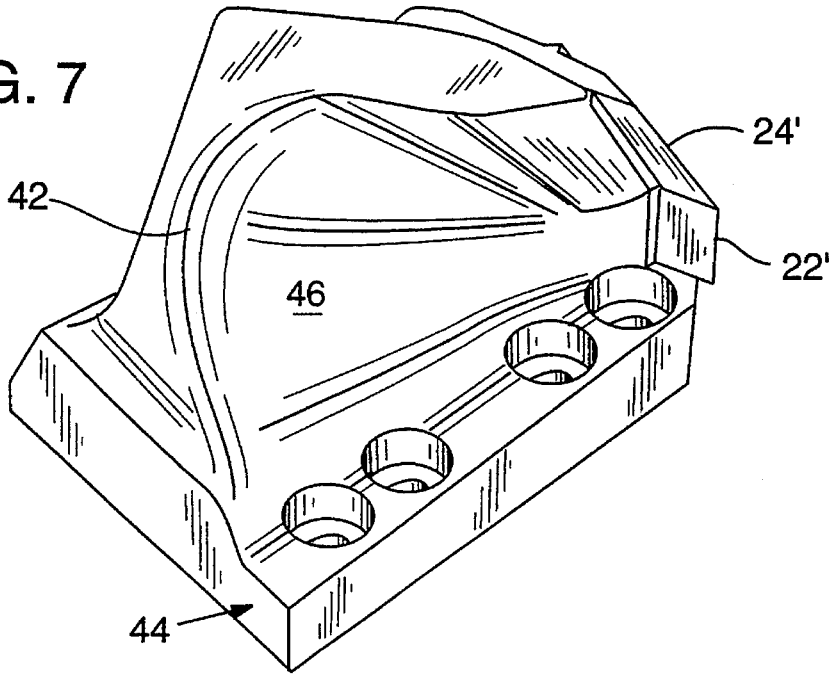
FIG. 7 is a perspective view of the blade holder of FIG. 4.
Figure 5:
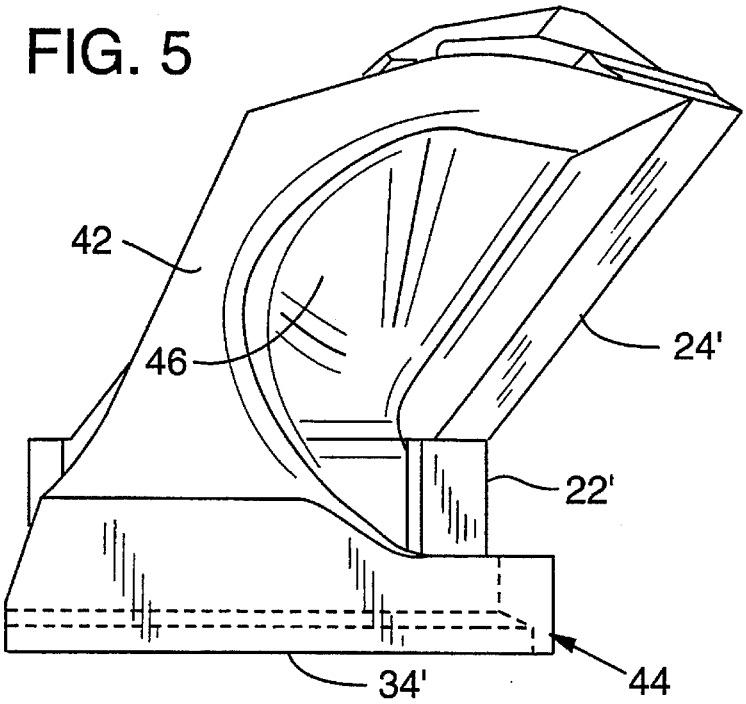
FIG. 5 is a view taken on view lines 5—5 of FIG. 4.
Figure 6:
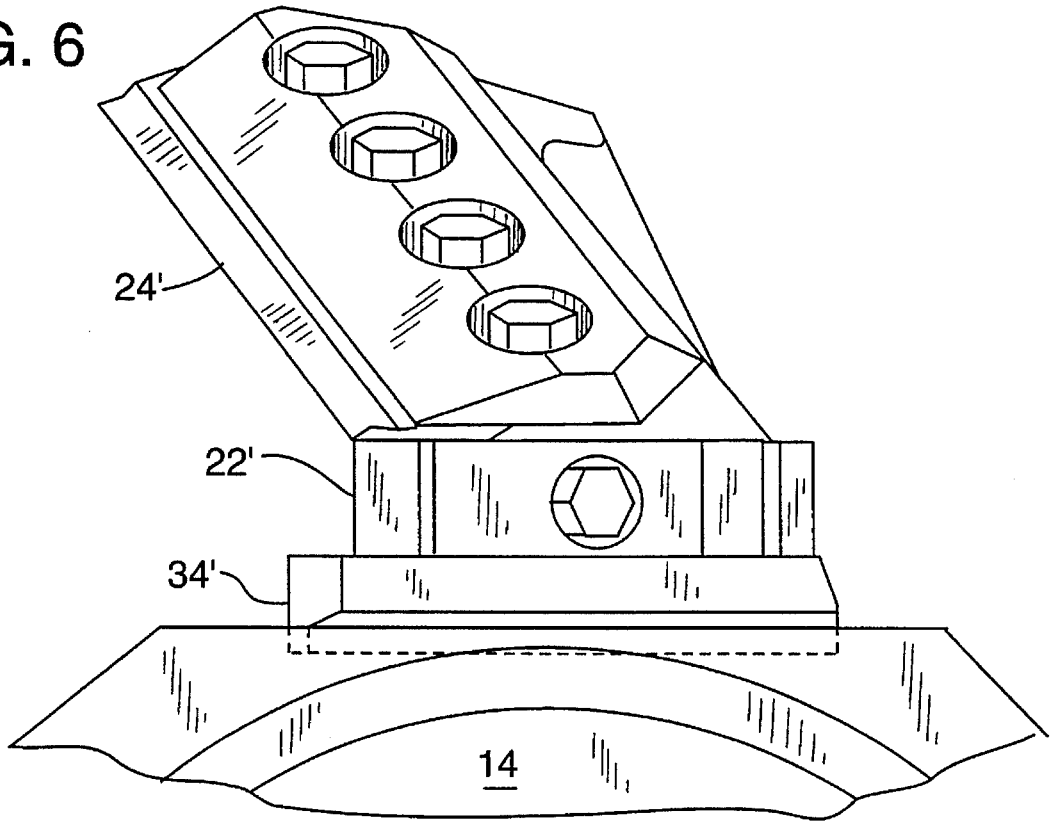
FIG. 6 is a view taken on view lines 6—6 of FIG. 4.

Reference is made to FIG. 1A which illustrates a chipper 16 in operation cutting a log 18. FIG. 1B is merely schematic and simply illustrates how the rotating cutting blades 22, 24 which are mounted on holders 20 (which in turn are mounted to faces or landings 23 formed on the periphery of disk 14) generate a frustoconical cutting path with angled blade 24 cutting the log side back to the desired chordal line 26, and finishing blades 22 aligned with chordal line 26 providing a finished appearance to the open face of the log. (Whereas only one chipper is illustrated, it will be appreciated that a second chipper is likely positioned at the opposite side.)

With reference to the prior art holder of FIGS. 2 and 3, the holder 20 of the chipper includes an outer leg 30, an inner leg 28, an upper body portion 32 and a base 34. An opening 36 is provided through the legs 28, 30 and under the body portion 32.

Two sets of chip flow paths are illustrated in FIGS. 2 and 3, Arrows 38 illustrate the heretofore perceived flow path whereas arrows 40 illustrate what has been found to be a more accurate flow path of the chips. The perceived flow path has the chips passing through opening 36. As illustrated by arrows 40, the chips travel in a more direct outward direction and a large portion impacts against leg 30. The impact is very great and the chips break up or are crushed making them less valuable for pulp production.

Figure 8:
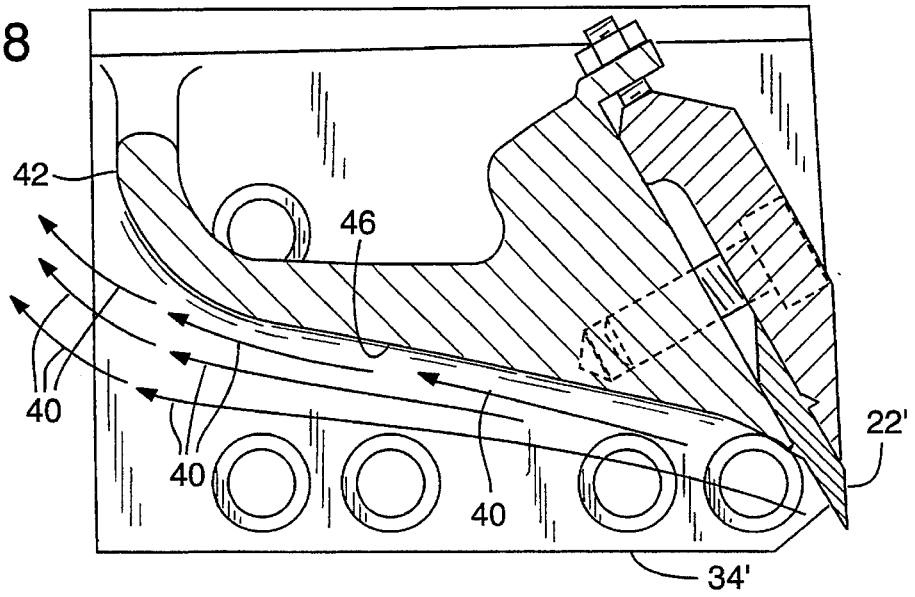
FIG. 8 is a view taken on view lines 8—8 of FIG. 4.

Whereas the combined support of legs 28 and 30 is needed to enable the holder to withstand the cutting forces, the present preferred embodiment provides the desired strength with a solid support wall. See FIGS. 4–8. Support wall 42 is configured to have an exposed surface 46 that is scoop shaped as illustrated. The exposed surface 46 of support wall 42 has a shallow concave curve formed at the inner end near blade 22'. The curve becomes deeper and higher as it extends toward the outer end (arrow 44). This scoop shape of wall 42 is particularly illustrated in FIGS. 4, 5, 7 and 8. The scoop shape of the exposed surface 46 of wall 42 is designed to accommodate the chip flow and to provide a ramp-like surface that receives and guides the chips toward the outer end of the blade holder (where they drop down onto a conveyor not shown). The top sectional view of FIG. 8 illustrates the flow path 40 which is accommodated by the scoop shape of the surface 46.

The above scoop shape configuration has been designed into a prototype blade holder and tested and has been found to perform in accordance with the illustrations and explanation provided above. The chips produced by the chipper have been found to be significantly less damaged.

A further benefit is realized. The outer leg 30 of the prior design is believed to produce air turbulence as the rotational speed of the chipper is very great. A high noise level results from the air turbulence and is a concern. The noise level of the scoop shape design is dramatically reduced and considered a significant added benefit.

Whereas the scoop shape design is considered the preferred design and has been satisfactorily demonstrated to reduce chip damage, the recognition of the problem and its solution, i.e., chip flow and elimination of barriers in the chip flow, suggests other possible designs. Whereas the outer leg of prior designs lies in the path of the chip flow, a multiple leg support design may be satisfactory if the outer leg is repositioned or reconfigured to be substantially rearwardly and thus out of the path of the chip flow. The opening between the legs is considered to add little or nothing for chip removal but may reduce weight. Providing the FIG. 4 embodiment with a center opening as indicated in dash lines produces inner support portion 28' (inner leg), outer support portion 30' (outer leg) and upper blade support portion 32'. The chip flow is not confined to a guided path as in the preferred design and it is expected that chip damage would not be reduced to the same extent as in the preferred embodiment.

Figure 9A:
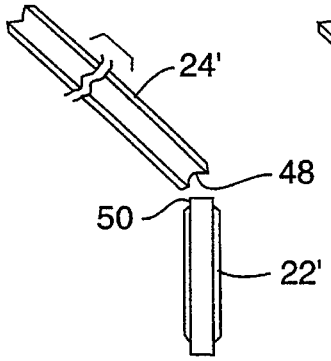
FIGS. 9A and 9B illustrate the two blade sections and the manner in which they interfit.
Figure 9B:
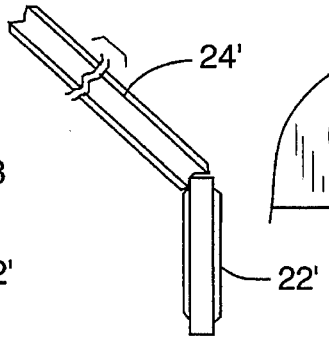

Reference is now made to FIGS. 9A and 9B. Whereas the prior chipper blades 22, 24 are simply abutted end to end and locked into place, the continual pounding of wood against the juncture between the blades can result in wood fiber being wedged into the juncture. As illustrated in FIG. 9A, the blade 24' is provided with an end groove 48 (at each end for reversibility). The groove 48 matches generally the configuration of corner 50 of blade 22'. As assembled in FIG. 9B, the corner 50 is nested in groove 48. The blades are thus interlocked and provided with added strength against blade deflection. This also provides blade edge overlap that largely prevents wood fibers from being pounded into the juncture.

Figure 10A:
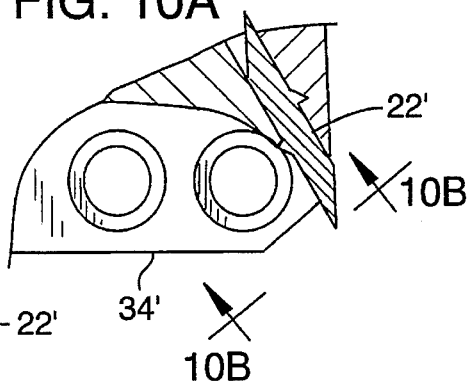
FIGS. 10A and 10B illustrate the mounting of the bottom blade section.
Figure 10B:
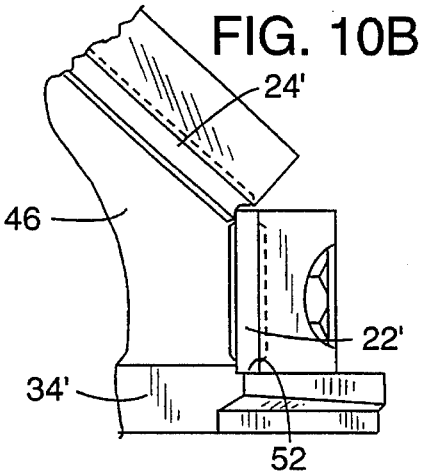

FIGS. 10A and 10B illustrate a further improvement. A second juncture between the short front facing blade 22' and the base 34' is also exposed to cutting impact and subject to wood fibers being pounded into the juncture. The base 34' is provided with an inset 52 and the blade 22' is set into the inset 52. This simulates a notch interfit and protects the juncture from wood fibers being wedged therein.

Figure 11:
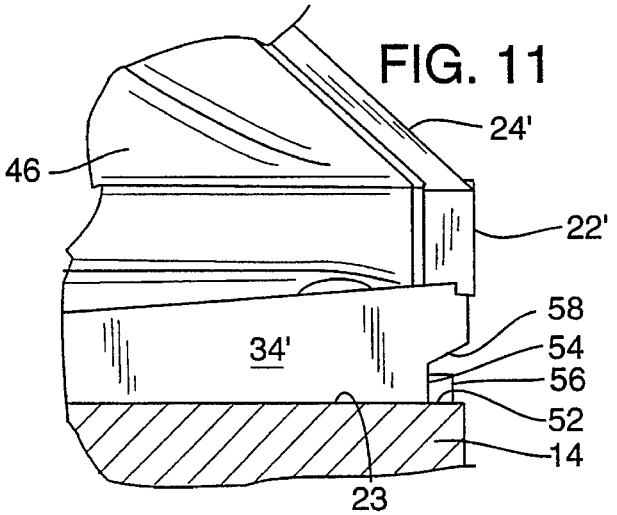
FIG. 11 is a partial view of the bottom inner corner of the blade holder shown in FIG. 4 illustrating the blade holder mounted to the disk of the chipper.

FIG. 11 illustrates the base 34' mounted to a landing 23 on disk 14. A notch 54 is typically provided in the base 34' and engages a locating shoulder 56. Whereas the notch and shoulder are also subjected to wood fiber penetration, the top of the notch 54 is angled (e.g., 45 degrees) as illustrated in FIG. 11 and indicated by reference number 58. The angled surface largely prevents fibers from being wedged into the notch 54.

The above-illustrated embodiments are preferred embodiments only and the invention is intended to encompass variations thereof that will be apparent to those skilled in the art. Accordingly the invention is to be determined from the definitions set forth in the appended claims hereto.

I claim:

1. A chipper blade holder for a chipper including a wheel-like disk having landings spaced around the peripheral edge of the disk and defining an inner disk side past which a log is conveyed for chipping, and an outer disk side opposite the inner disk side, and said chipper rotatable about its axis whereby the landings have a leading edge and a trailing edge as determined by the direction of rotation, said chipper blade holder adapted to mount to a landing on the disk and comprising:

a base attachable to the landing on the disk, a support extended radially outwardly of the base and having an inner support portion to be positioned adjacent the inner disk side and an outer support portion to be positioned outwardly of the inner disk side, and an upper blade support portion extended across the inner and outer support portions and inclined radially outwardly from the inner disk side toward the outer disk side;

a knife including an upper knife portion mounted to the blade support portion and having a knife edge extended from a position adjacent the inner disk side and inclined as dictated by the upper blade support portion; and said outer support portion having an upper end supporting the blade support portion and a lower end secured to the base, said outer support portion positioned rearwardly of the knife edge and configured to be rearwardly of the flow path of chips generated by the knife edge.

2. A chipper blade as defined in claim 1 wherein the inner support, outer support and upper blade support are an integral wall support, said integral wall support being scoop shaped with a shallow concave curve adjacent the inner disk side and becoming expanded in height and depth in the direction of the outer disk side, the concave surface of the wall providing a smooth surface configured to guide the chip flow past the wall support.

3. A chipper blade as defined in claim 1 wherein the knife is a bent knife including an inner knife portion mounted to the inner support portion and having a knife edge positioned at the inner disk side.

4. A chipper blade assembly for chipping wood, comprising:

a blade holder and a bent blade mounted in the blade holder, said bent blade including two separate blade portions in end-to-end abutment and defining the bend at the juncture between the blade portions, the end of one of said blade portions configured to form a groove in the end of said one of said blade portions and the end of the other of said blade portions having an edge fitted to the groove whereby there is overlapping of the blade portions at the juncture for strength and resistance to wedging of wood fibers in the juncture.

5. A chipper blade assembly as defined in claim 4 wherein one of the blade portions is vertically positioned in the blade holder and the end opposite the juncture abuts a base portion of the blade holder and forms a second juncture with said base portion, said base portion having an inset receiving said opposite end of the one blade portion for overlapping the juncture and resisting wedging of wood fibers.

* * * * *